US008026935B2

(12) United States Patent
Tsai et al.

(10) Patent No.: US 8,026,935 B2
(45) Date of Patent: Sep. 27, 2011

(54) LOW-BACKLIGHT IMAGE VISIBILITY ENHANCEMENT METHOD AND SYSTEM

(75) Inventors: Pei-Shan Tsai, Taipei (TW); Homer H. Chen, Taipei (TW); Chia-Kai Liang, Taipei (TW)

(73) Assignee: National Taiwan University, Taipei (TW)

( * ) Notice: Subject to any disclaimer, the term of this patent is extended or adjusted under 35 U.S.C. 154(b) by 741 days.

(21) Appl. No.: 12/165,263

(22) Filed: Jun. 30, 2008

(65) Prior Publication Data

US 2009/0184915 A1 Jul. 23, 2009

(30) Foreign Application Priority Data

Jan. 21, 2008 (TW) ..... 97102148 A

(51) Int. Cl.
*G09G 5/10* (2006.01)

(52) U.S. Cl. ..... 345/690; 345/102

(58) Field of Classification Search ..... 345/690, 345/89, 102

See application file for complete search history.

(56) References Cited

U.S. PATENT DOCUMENTS

| | | | | |
|---|---|---|---|---|
| 4,812,903 | A * | 3/1989 | Wagensonner et al. | 358/521 |
| 5,589,890 | A * | 12/1996 | Mancuso et al. | 348/678 |
| 5,760,843 | A * | 6/1998 | Morimura et al. | 348/678 |
| 2001/0024242 | A1* | 9/2001 | Takeuchi | 348/746 |
| 2005/0190200 | A1* | 9/2005 | Arazaki | 345/600 |
| 2006/0017662 | A1* | 1/2006 | Beuker et al. | 345/72 |
| 2007/0183678 | A1* | 8/2007 | Sankar et al. | 382/254 |
| 2008/0291153 | A1* | 11/2008 | Zhang et al. | 345/102 |
| 2009/0226110 | A1* | 9/2009 | Chen et al. | 382/263 |

* cited by examiner

*Primary Examiner* — Chanh Nguyen
*Assistant Examiner* — Robert Stone

(57) ABSTRACT

A low-backlight image visibility enhancement method and system is proposed for integration to a backlit type of display unit, such as active matrix LCD (Liquid Crystal Display). The proposed method and system firstly converts the image of each video frame into a brightness-based grayscale image; then decomposes the grayscale image into a low-pass base layer and a high-pass detail layer; and then performs a brightness compensation for the base-layer image and a contrast enhancement for the detail-layer image; and finally combines the two image layers into one single image and performs color conversion to the combined image. The resulted image is then used for display on the display unit. This feature allows the display unit to use a low level of backlight to save electrical power consumption while nevertheless allow the image to be displayed with good visibility.

17 Claims, 4 Drawing Sheets

LOW-BACKLIGHT IMAGE VISIBILITY ENHANCEMENT METHOD AND SYSTEM

BACKGROUND OF THE INVENTION

1. Field of the Invention

This invention relates to image processing technology, and more particularly, to a low-backlight image visibility enhancement method and system which is designed for use with a backlit-type of display unit, such as a TFT-LCD (Thin-Film Transistor Liquid Crystal Display) active matrix display unit, for visibility enhancement of the video images displayed on the display unit under a low-backlight condition.

2. Description of Related Art

TFT-LCD (Thin-Film Transistor Liquid Crystal Display) is a dot-matrix display technology widely utilized on various types of personal computers and portable electronic devices such as notebook computers and intelligent mobile phones. The TFT-LCD is equipped with an N×M dot matrix which is an array of N rows and M columns of pixels, wherein each pixel is capable of displaying a particular color or grayscale value in response to the charging of a particular level of data voltage thereto.

Fundamentally, the liquid crystal material used by TFT-LCD is incapable of light emitting, but it has a light transmittance that can be varied by the externally applied voltage; i.e., its light transmittance is nearly 100% when the externally applied voltage is zero, and nearly 0% when the externally applied voltage is at a certain maximum magnitude. Therefore, the externally applied voltage can be varied between zero and the maximum magnitude to render the LCD pixels to visually display specific grayscale levels. For this sake, TFT-LCD should be equipped with a backlighting module that can generate a backlight to illuminate the TFT-LCD dot-matrix screen during operation.

In the applications on notebook computers and mobile phones, since these portable devices are battery powered, the operation of TFT-LCD should be power efficient. However, since the backlighting module on TFT-LCD is used for light emitting, which is power consumptive, it will cause the battery to have a shortened life of use. One solution to this problem is to lower the backlight intensity. However, one drawback to this solution is that it would cause the displayed image to have a dimmed level of visibility to the user who might be unable to view the displayed image clearly.

In view of the aforementioned problem, it is a research effort in the computer industry for a new TFT-LCD technology that can use a lowered level of backlight while nonetheless allowing the displayed image to have a good level of visibility to the user.

SUMMARY OF THE INVENTION

It is therefore an objective of this invention to provide a low-backlight image visibility enhancement method and system for use on TFT-LCD that allows TFT-LCD to use a lowered level of backlight while nonetheless allowing the displayed image to have a good level of visibility to the user.

The low-backlight image visibility enhancement method according to the invention comprises: (M1) setting a backlight reduction ratio as a control parameter which is the ratio of the actual backlight intensity produced by the backlit-type display unit during operation against a rated maximum backlight intensity; (M2) extracting the brightness information of the input image to thereby produce a luminance-based image; (M3) decomposing the luminance-based image into a base-layer image and a detail-layer image, wherein the base-layer image is a low-pass filtered version of the original luminance-based image within a low-pass band, while the detail-layer image is a high-pass filtered version of the original luminance-based image within a high-pass band beyond the low-pass band; (M4) performing a brightness compensation process on the base-layer image in accordance with an average-brightness mapping scheme based on the backlight reduction ratio and the average brightness value of the input image to thereby produce a brightness-compensated base-layer image; (M5) performing a contrast enhancement process on the detail-layer image to thereby produce a contrast-enhanced detail-layer image; (M6) superimposing the brightness-compensated base-layer image with the contrast-enhanced detail-layer image to thereby produce a single combined image; and (M7) performing a color conversion process on the combined image produced by the image superimposition module to thereby produce an output image for displaying on the backlit-type display unit.

In architecture, the low-backlight image visibility enhancement system according to the invention comprises: (A) a backlight reduction ratio setting module; (B) an image brightness extraction module; (C) an image decomposition module; (D) a brightness compensation module; (E) a contrast enhancement module; (F) an image superimposition module; and (G) a color conversion module.

The low-backlight image visibility enhancement method and system according to the invention is characterized by the capability of firstly converting the image of each video frame into a brightness-based grayscale image; secondly decomposing the grayscale image into a low-pass base layer and a high-pass detail layer; thirdly performing a brightness compensation for the base-layer image and a contrast enhancement for the detail-layer image; and finally superimposing the two image layers into one single image and performing color conversion to the combined image. The resulted image is then used for display on the display unit. This feature allows the display unit to use a low level of backlight to save electrical power consumption while nevertheless allow the image to be displayed with good visibility to the user.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

The low-backlight image visibility enhancement method and system according to the invention is disclosed in full details by way of preferred embodiments in the following with reference to the accompanying drawings.

Application and Function of the Invention

Figure 1A:
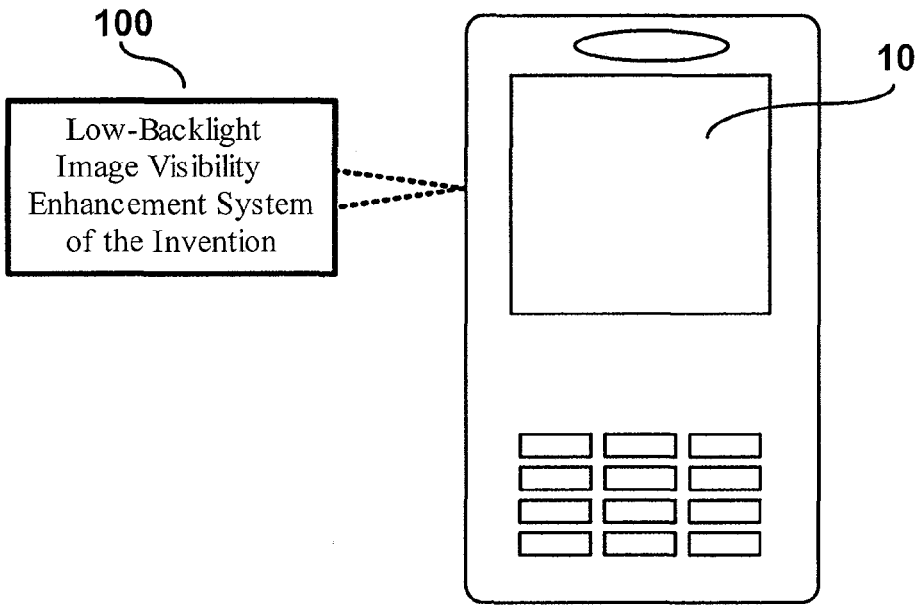
FIGS. 1A-1B are schematic diagrams used to depict the application and function of the low-backlight image visibility enhancement system of the invention.
Figure 1B:
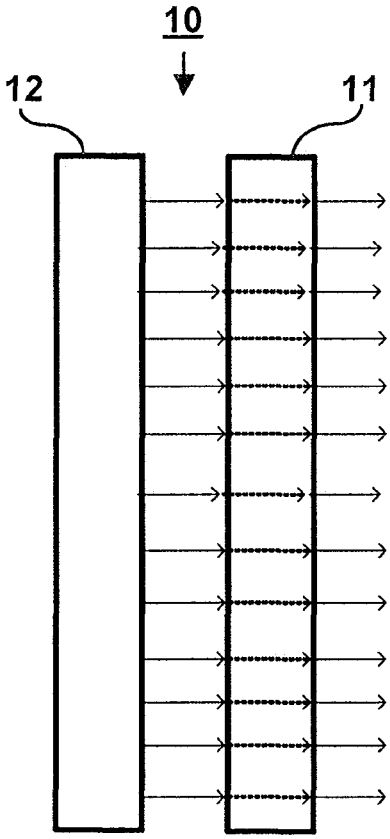

FIGS. 1A-1B are schematic diagrams used to depict the application and function of the low-backlight image visibility enhancement system according to the invention (which is here encapsulated in a box indicated by the reference numeral 100). As shown, the low-backlight image visibility enhancement system of the invention 100 is designed for integration to a backlit-type display unit 10, such as an TFT-LCD (Thin-Film Transistor Liquid Crystal Display) active matrix display unit. As shown in FIG. 1B, the TFT-LCD unit 10 includes a dot-matrix screen 11 and a backlighting module 12, wherein the dot-matrix screen 11 is composed of an N×M array of TFT-LCD pixels for displaying video images, while the backlighting module 12 serves as a light source at the back of the dot-matrix screen 11 for providing a backlight source to illuminate the dot-matrix screen 11 during operation.

Figure 2:
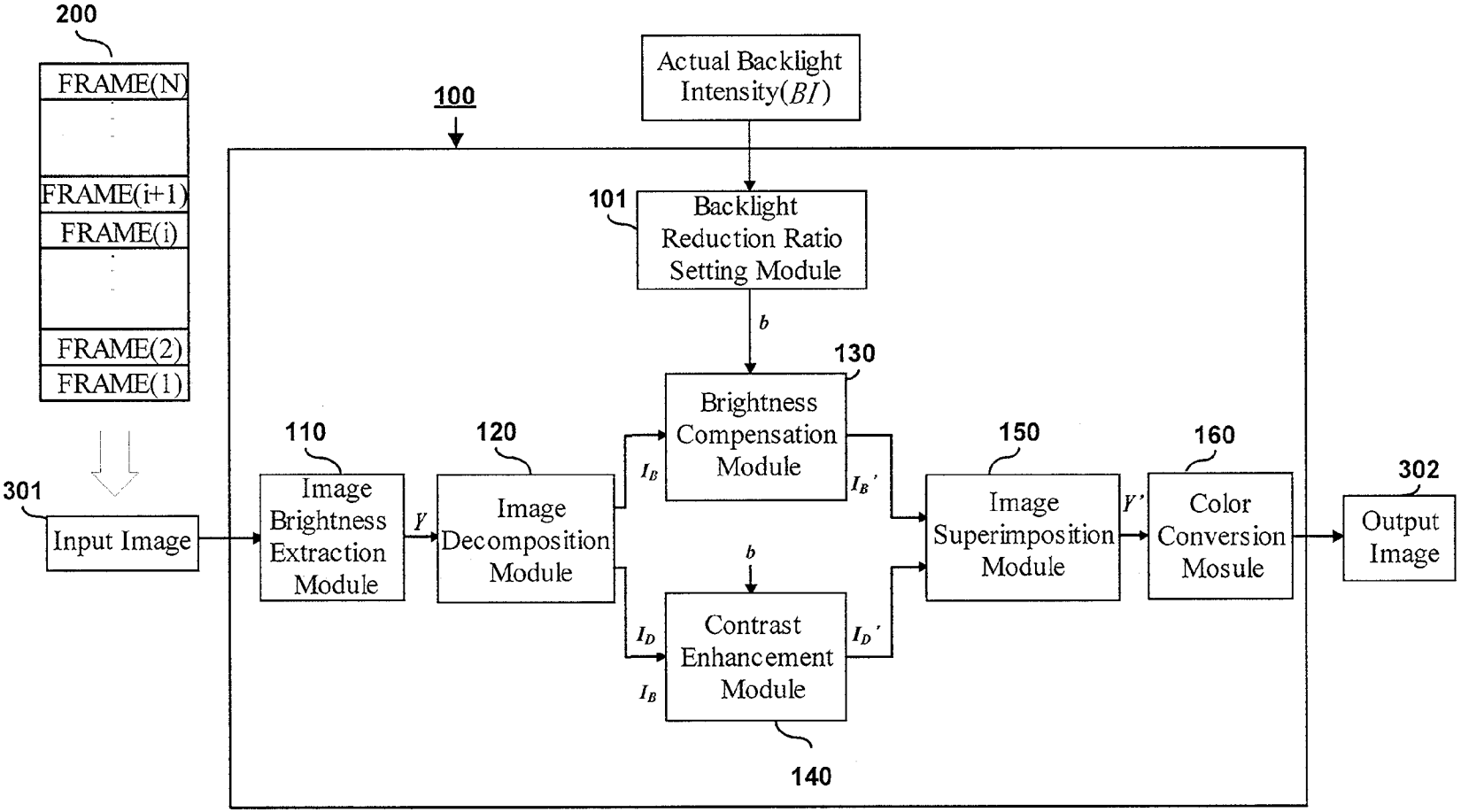
FIG. 2 is a block diagram showing the architecture of the low-backlight image visibility enhancement system of the invention.

In operation, the low-backlight image visibility enhancement system of the invention 100 is capable of performing visibility enhancement on each frame of a video stream 200 (shown in FIG. 2 represented by FRAME (i), i=1 to N which are to be successively displayed on the TFT-LCD unit 10) under the condition that the backlight intensity (represented by BI) generated by the backlighting module 12 is reduced to a dim level that causes low visibility for the user to view the displayed image clearly. The low-backlight image visibility enhancement system of the invention 100 receives each frame of the video stream 200 as an input image 301, then performs a visibility enhancement process on each input image 301, and finally outputs the visibility-enhanced output image 302 for displaying on the dot-matrix screen 11 of the TFT-LCD unit 10.

Architecture of the Invention

As shown in FIG. 2, in architecture, the low-backlight image visibility enhancement system of the invention 100 comprises: (A) a backlight reduction ratio setting module 101; (B) an image brightness extraction module 110; (C) an image decomposition module 120; (D) a brightness compensation module 130; (E) a contrast enhancement module 140; (F) an image superimposition module 150; and (G) a color conversion module 160. Firstly, the respective attributes and functions of these constituent components of the invention are described in details in the following.

Backlight Reduction Ratio Setting Module 101

The backlight reduction ratio setting module 101 is capable of setting a backlight reduction ratio (represented by b) for use as a control parameter in the visibility enhancement process. The backlight reduction-ratio b is here defined as the ratio of the actual backlight intensity (represented by BI) produced by the backlighting module 12 of the TFT-LCD unit 10 during actual operation against a rated maximum backlight intensity (represented by $BI_{max}$, which is defined as the standard rated backlight intensity used by traditional TFT-LCD), i.e., $$b=BI/BI_{max}$$

The range of b is from 0 to 1, where b=0 represents the condition of no backlight, while b=1 represents the condition of rated maximum backlight. In practical applications, this backlight reduction ratio setting module 101 can be implemented in two different schemes: a factory-setting scheme and an auto-detection setting scheme.

By the factory-setting scheme, the backlight reduction ratio b is factory-set by the manufacturer in production line; i.e., the manufacturer first calculates the backlight reduction ratio b by comparing the measured level of backlight intensity BI produced by the backlighting module 12 against the rated maximum backlight intensity $BI_{max}$, and then embed the value of b in a permanent storage device such as flash memory (not shown) in the TFT-LCD unit 10.

By the auto-detection setting scheme, the backlight reduction ratio b is automatically set by the backlight reduction ratio setting module 101 each time after power-on during actual operation by first measuring the level of backlight intensity BI produced by the backlighting module 12, then comparing the measured value of BI against the rated maximum backlight intensity $BI_{max}$ to obtain the value of b, and then setting the value of b in a register or memory location (not shown) in the TFT-LCD unit 10.

Image Brightness Extraction Module 110

The image brightness extraction module 110 is capable of extracting the brightness information (i.e., luminance) of each input image 301 from the video stream 200, i.e., FRAME(i), to thereby produce a luminance-based image (represented by Y). In this luminance-based image Y, each pixel contains only the brightness information of each pixel of the input image 301.

In actual implementation, for example, the image brightness extraction module 110 performs the brightness extraction by using the following NTSC (National Television System Committee) standard formula:

$$Y=0.299*R+0.587*G+0.114*B$$

where

Y is the luminance of each pixel of the processed image; and

R, G, B are the red, green, and blue values of each pixel of the original input image 301.

Image Decomposition Module 120

The image decomposition module 120 is capable of decomposing the luminance-based image Y created by the image brightness extraction module 110 into a base-layer image (represented by $I_B$) and a detail-layer image (represented by $I_D$), wherein the base-layer image $I_B$ is a low-pass filtered version of the original luminance-based image Y within a predefined low-pass band LPB, while the detail-layer image $I_D$ is a high-pass filtered version of the original luminance-based image Y within a high-pass band HPB beyond LPB.

In practical applications, for example, the image decomposition module 120 can be implemented in two different embodiments.

By the first embodiment, the image decomposition module 120 is implemented with a bilateral filter that is capable of providing a low-pass filtering function and a high-pass filtering function, wherein the low-pass filtering function is used to produce the base-layer image $I_B$ while the high-pass filtering function is used to produce the detail-layer image $I_D$. This bilateral filter is based on principle and theory disclosed in the following technical paper "Fast bilateral filtering for the display of high-dynamic-range images", authored by F. Durand et al and published on Proceeding of the 29th Annual Conference on Computer Graphics and Interactive Techniques, New York, 2002, pp. 257-266), so detailed description thereof will not be given in this specification.

Figure 3:
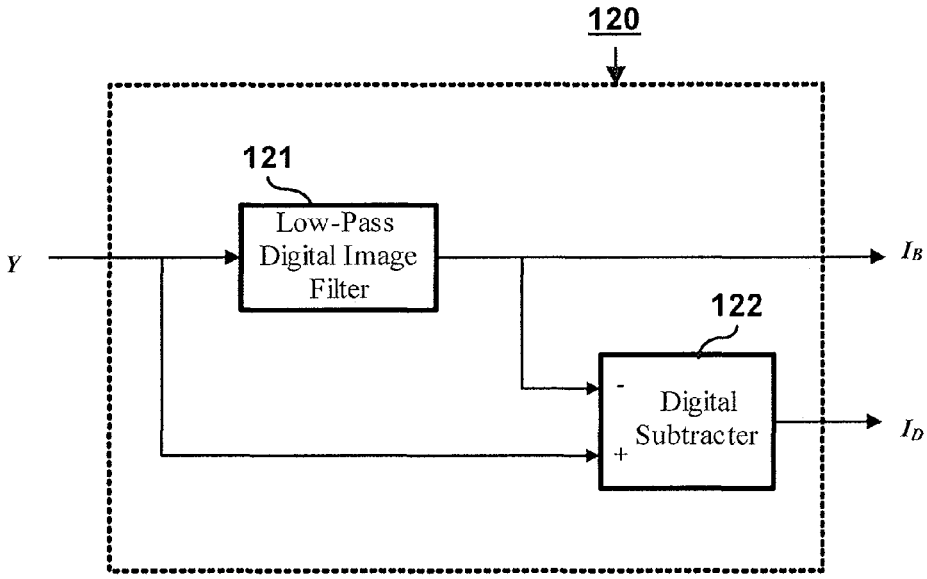
FIG. 3 is a schematic diagram showing a preferred embodiment of the internal architecture of the image decomposition module utilized by the low-backlight image visibility enhancement system of the invention.

By the second embodiment, as shown in FIG. 3, the image decomposition module 120 is implemented with the combination of a low-pass digital image filter 121 and a digital subtracter 122. The low-pass digital image filter 121 is capable of performing a low-pass filtering process on the luminance-based image Y to thereby produce a low-band digital image Y1, which can be implemented with the following 3×3 Gaussian low-pass filter:

$$\begin{bmatrix} 1 & 2 & 1 \\ 2 & 4 & 2 \\ 1 & 2 & 1 \end{bmatrix}$$

On the other hand, the digital subtracter 122 is capable of performing a subtraction process on the luminance-based image Y and the low-band digital image Y1 to thereby produce a high-band digital image Y2, where Y2=Y−Y1. The output image Y1 of the low-pass digital image filter 121 then serves as the base-layer image $I_B$, while the output image Y2 of the digital subtracter 122 serves as the detail-layer image $I_D$.

In performance comparison of the above two embodiments, the first embodiment is more time-timing in process since the bilateral filter is quite complicated in algorithm. By comparison, the second embodiment is more efficient and quicker due to the use of the low-pass digital image filter 121 which is based on a much simpler algorithm. Therefore, the second embodiment is more preferable for use than the first embodiment, and serves as the best mode embodiment.

Brightness Compensation Module 130

The brightness compensation module 130 is capable of performing a brightness compensation process on the base-layer image $I_B$ produced by the image decomposition module 120 to thereby produce a brightness-compensated base-layer image (represented by $I_B'$).

In practical applications, for example, this brightness compensation module 130 is implemented with an average-brightness mapping scheme, which includes the following three steps (S1)-(S3):

(S1) Compute for the average brightness value (represented by μ) of the base-layer image $I_B$;

(S2) Compute for the brightness clipping threshold value (represented by θ) based on the parameters (μ, b) as follows:

$$\theta = \begin{cases} \theta_{min} & \mu < 64 \\ (\mu - 64) \cdot \dfrac{(\theta_{max} - \theta_{min})}{64} + \theta_{min} & 64 \le \mu < 128 \\ \theta_{max} & 128 \le \mu \end{cases}$$

where $$\theta_{max} = 255$$

$$\theta_{min} = 255 \cdot b$$

(S3)Computer for the brightness compensation value $I_B'(z)$ for each pixel of the base-layer image $I_B$ based on ($I_B(z)$, θ) as follows:

$$I_B'(z) = \begin{cases} \frac{2}{3} \cdot [m \cdot (I_B(z) - \theta_{min})^2 + n] + \frac{1}{3} \cdot (255 \cdot I_B(z)/\theta) & I_B(z) \le \theta_{min} \\ \dfrac{255 - n}{\theta - \theta_{min}} \cdot (I_B(z) - \theta_{min}) + n & \theta_{min} < I_B(z) \le \theta \\ 255 & \theta < I_B(z) \end{cases}$$

where $I_B(z)$ is the brightness value of the (z)th pixel of the original base-layer image $I_B$;

$$n = 255 \square \theta_{min}/\theta$$

$$m = -n/\theta_{min}^2$$

Figure 4:
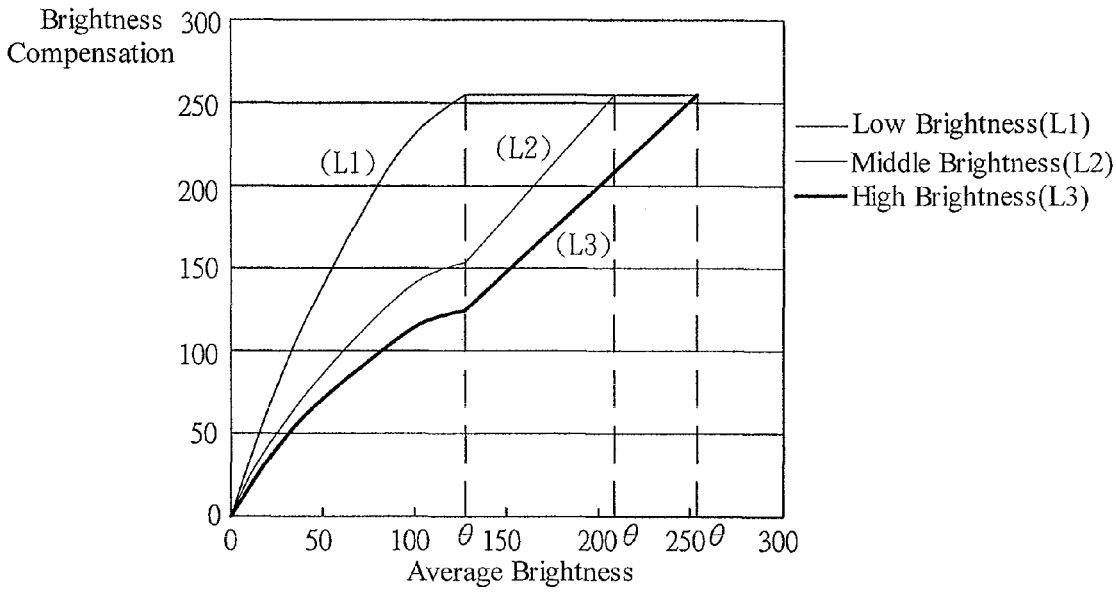
FIG. 4 is a graph showing the brightness compensation method used by the low-backlight image visibility enhancement system of the invention.

The principle and theory of the algorithm of the average-brightness mapping scheme is explained as follows. In this average-brightness mapping scheme, the average brightness value μ is divided into a number of levels. In this embodiment, for example, the average brightness value μ is divided into 3 levels: (1) a low brightness level, μ<64; (2) a middle brightness level, 64□μ<128; and (3) a high brightness level, 128□μ. The brightness compensation for each of these 3 different brightness levels is shown in FIG. 4.

In the case of low brightness level (μ<64), it indicates that the base-layer image $I_B$ contains only a few number of pixels of high brightness. Accordingly, the brightness clipping threshold value θ is set to a small value. In this embodiment, $\theta = \theta_{min} = 255 \cdot b$, whereby the majority of the pixels can be raised in brightness.

On the other hand, in the case of high brightness level (128□μ), it indicates that the base-layer image $I_B$ contains quite a large number of pixels of high brightness. Accordingly, the brightness clipping threshold value θ is set to the maximum possible value, i.e., $\theta = \theta_{max} = 255$. This can prevent the majority of the pixels from whitening due to a raise in brightness.

Further, in the case of middle brightness level (64⌈μ<128), the brightness clipping threshold value θ is set to be linearly corresponding to the average brightness value μ i.e., a smaller value of μcorresponds a larger value of θ. The linear relationship between θ and μ is shown in the equation of the foregoing step (S2)

Contrast Enhancement Module 140

The contrast enhancement module 140 is capable of performing a contrast enhancement process on the detail-layer image $I_D$ based on the backlight reduction ratio b to thereby produce a contrast-enhanced detail-layer image (represented by $I_D'$).

In practical applications, for example, the contrast enhancement module 140 is implemented with a Weber's law based contrast enhancement algorithm. Details about the Weber's law can be found in the textbook "Digital Image Processing" chapter 2, authored by W. K. Pratt and published by John Wiley and Sons, 2001, as well as the textbook "Image Processing" chapter 3, authored by T. Acharya, A. K. Ray and published by John Wiley and Sons, 2005; so detailed description about the Weber's law will not be given in this specification.

The Weber's law based contrast enhancement algorithm is briefly described as follows. Assume the (z)th pixel in the detail-layer image $I_D$ has a brightness value of $I_D(z)$, and which has a brightness value of $I_D'(Z)$ after contrast enhancement, then $I_D'(Z)$ is related to backlight reduction ratio b as follows:

$$I_D'(z) = \zeta(z)/b$$

where $$\zeta(z) = \frac{I_D(z)}{I_B(z)} \cdot I_B'(z)$$

Image Superimposition Module 150

The image superimposition module 150 is capable of superimposing the brightness-compensated base-layer image $I_B'$ (the output image of the brightness compensation module 130) with the contrast-enhanced detail-layer image $I_D'$ (the output image of the contrast enhancement module 140) to thereby produce a combined single image (represented by Y'). This image superimposition process is based on the following equation:

$$Y'(z)=I_B'(z)+I_D'(z)$$

Color Conversion Module 160

The color conversion module 160 is capable of performing a color conversion process on the output image Y' of the image superimposition module 150 to thereby produce an output image 302 for displaying on the TFT-LCD unit 10. This color conversion process is used to apply the original RGB color information back to the combined image Y' which is in grayscale form. Since the brightness of each pixel will be changed after being processed by the brightness compensation module 130 and the contrast enhancement module 140, the color conversion process utilizes the ratio Y'/Y for color correction. Assume $[R, G, B]^T$ represents the color information of the input image 301, and $[R', G', B']^T$ represents the color information of the output image 302, then color conversion process is based on the following equation:

$$\begin{bmatrix} R' \\ G' \\ B' \end{bmatrix} = \begin{bmatrix} Y'/Y & 0 & 0 \\ 0 & Y'Y & 0 \\ 0 & 0 & Y'/Y \end{bmatrix} \cdot \begin{bmatrix} R \\ G \\ B \end{bmatrix}$$

The output image 302 produced by the color conversion module 160 is then transferred to the TFT-LCD unit 10 for displaying on the dot-matrix screen 11.

Operation of the Invention

The following is a detailed description of the operation of the low-backlight image visibility enhancement system of the invention 100 during actual application.

During operation of the TFT-LCD unit 10, it will display a video stream 200 in a frame by frame manner on the dot-matrix screen 11. Before each frame is actually displayed, it will be first processed by the low-backlight image visibility enhancement system of the invention 100 for visibility enhancement.

In the first step, the low-backlight image visibility enhancement system of the invention 100 reads the current frame of the video stream 200 as an input image 301, and then activates the image brightness extraction module 110 to extract the brightness information of the input image 301 to thereby produce a luminance-based image Y. Next, the image decomposition module 120 is activated to decompose the luminance-based image Y into a base-layer image $I_B$ and a detail-layer image $I_D$, wherein the base-layer image $I_B$ is a low-pass filtered version of the original luminance-based image Y within a predefined low-pass band LPB, while the detail-layer image $I_D$ is a high-pass filtered version of the original luminance-based image Y within a high-pass band HPB beyond the low-pass band LPB.

Subsequently, the brightness compensation module 130 is activated to perform a brightness compensation process on the base-layer image $I_B$ produced by the image decomposition module 120 to thereby produce a brightness-compensated base-layer image $I_B'$. Further, the contrast enhancement module 140 is activated to perform a contrast enhancement process on the detail-layer image ID based on the backlight reduction ratio b to thereby produce a contrast-enhanced detail-layer image $I_D'$. Subsequently, the image superimposition module 150 is activated to superimpose the brightness-compensated base-layer image $I_B'$ with the contrast-enhanced detail-layer image $I_D'$ to thereby produce a single combined image (represented by Y').

Finally, the color conversion module 160 is activated to perform a color conversion process on the combined image Y' produced by the image superimposition module 150 to thereby produce an output image 302 for displaying on the TFT-LCD unit 10.

After the current frame is displayed on the dot-matrix screen 11, the low-backlight image visibility enhancement system of the invention 100 subsequently reads the next frame in the video stream 200 as the next input image 301 and performs the same image visibility enhancement process on the input image 301. This image enhancement process is repeated for each frame of the video stream 200.

Speed Boosting Operating Scheme

In addition, the low-backlight image visibility enhancement system of the invention 100 can be operated in the following two different operating schemes: a sequential operating scheme and a parallel-processing operating scheme.

By the sequential operating scheme, the low-backlight image visibility enhancement system of the invention 100 receives each frame of the video stream 200 in a sequential manner, and then processes each frame by using the image brightness extraction module 110 through the color conversion module 160. However, this sequential operating scheme is slow in overall processing speed. Therefore, for operational speedup, the parallel-processing operating scheme can be used.

By the parallel-processing operating scheme, the input to the image decomposition module 120 (i.e., the luminance-based image Y) is the luminance-based image Y of the preceding frame rather than the current frame. For the very first frame FRAME(1) in the video stream 200, the brightness compensation is based on the following equation:

$$I_B'(z) = \begin{cases} I_B(z)/b & I_B(z) \le \theta_{min} \\ 255 & I_B(z) > \theta_{min} \end{cases}$$

The fundamental concept behind the parallel-processing operating scheme is that most two consecutive frames in the video stream 200 only have slight difference in average brightness except that the two consecutive frames are two different scenes, such as a daytime scene and a night scene. However, in most cases, after such a change of scene, most of the succeeding frames will have slight changes in average brightness. Therefore, an abrupt change of average brightness typically happens at a change from the last frame of a previous scene to the first frame of the next scene. However, since t a video stream typically refreshes the frames at a very fast rate, the human vision would normally be unable to perceive such aberration in the brightness of the displayed frames.

Figure 5A:
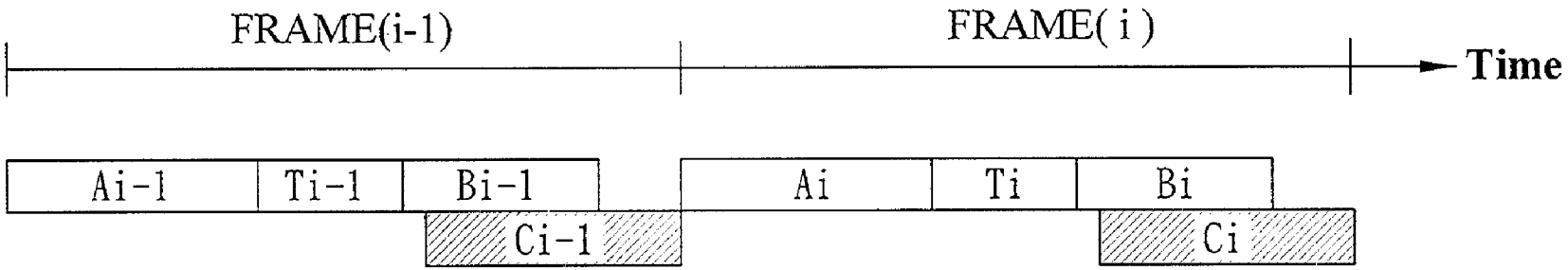
FIGS. 5A-5B are schematic diagrams used to depict the concept of a parallel-processing operating scheme utilized by the low-backlight image visibility enhancement system of the invention for speed boosting.
Figure 5B:
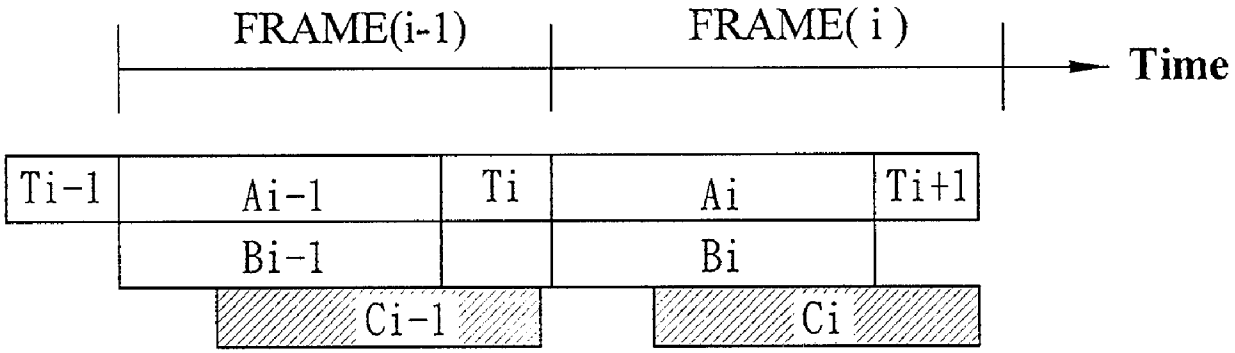

FIGS. 5A-5B are schematic diagrams used to depict the concept of the above-mentioned two operating schemes. In FIGS. 5A-5B, it is assumed that $A_i$ represents the process during which the (i)th frame FRAME(i) is being read as input by the low-backlight image visibility enhancement system of the invention 100; $T_i$ represents the process during which the brightness compensation module 130 is being activated to process FRAME(i) for obtaining $I_B'(z)$; $B_i$ represents the process during which a brightness compensation procedure is being performed on FRAME(i) based on $I_B'(z)$; and $C_i$ represents the process during which a contrast enhancement procedure is being performed on FRAME(i).

It can be seen from FIG. 5A that the sequential operating scheme renders $A_i$ and $B_i$ to be executed in a sequential manner, i.e., after $A_i$ is completed, $B_i$ can be carried out only after $T_i$ is first carried out and completed. In other words, no concurrent parallel processing is possible. However, it can be seen from FIG. 5B that the parallel-processing operating scheme allows $A_i$ and $B_i$ to be executed concurrently at the same time, which can help boost the overall processing speed.

In conclusion, the invention provides a low-backlight image visibility enhancement method and system which is characterized by the capability of firstly converting the image of each video frame into a brightness-based grayscale image; secondly decomposing the grayscale image into a low-pass base layer and a high-pass detail layer; thirdly performing a brightness compensation for the base-layer image and a contrast enhancement for the detail-layer image; and finally superimposing the two image layers into one single image and performing color conversion to the combined image. The resulted image is then used for display on the display unit. This feature allows the display unit to use a low level of backlight to save electrical power consumption while nevertheless allow the image to be displayed with good visibility to the user. The invention is therefore more advantageous to use than the prior art.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A low-backlight image visibility enhancement method for use on a backlit-type display unit for visibility enhancement of an input image that is to be displayed on the backlit-type display unit under a low-backlight condition;

the low-backlight image visibility enhancement method comprising:

setting a backlight reduction ratio as a control parameter which is the ratio of the actual backlight intensity produced by the backlit-type display unit during operation against a rated maximum backlight intensity;

extracting the brightness information of the input image to thereby produce a luminance-based image;

decomposing the luminance-based image into a base-layer image and a detail-layer image, wherein the base-layer image is a low-pass filtered version of the original luminance-based image within a low-pass band, while the detail-layer image is a high-pass filtered version of the original luminance-based image within a high-pass band beyond the low-pass band;

performing a brightness compensation process on the base-layer image in accordance with an average-brightness mapping scheme based on the backlight reduction ratio and the average brightness value of the input image to thereby produce a brightness-compensated base-layer image;

performing a contrast enhancement process on the detail-layer image to thereby produce a contrast-enhanced detail-layer image;

superimposing the brightness-compensated base-layer image with the contrast-enhanced detail-layer image to thereby produce a single combined image; and performing a color conversion process on the combined image to thereby produce an output image for displaying on the backlit-type display unit.

2. The low-backlight image visibility enhancement method of claim 1, wherein the setting of the backlight reduction-ratio is implemented with a factory-setting scheme.

3. The low-backlight image visibility enhancement method of claim 1, wherein the setting of the backlight reduction-ratio is based on an auto-detection setting scheme by which the actual level of backlight intensity produced by the backlit-type display unit is measured during operation and compared against the rated maximum backlight intensity to obtain the value of the backlight reduction ratio.

4. The low-backlight image visibility enhancement method of claim 1, wherein the image brightness extraction process is based on a NTSC (National Television System Committee) standardized algorithm.

5. The low-backlight image visibility enhancement method of claim 1, wherein the brightness compensation process is implemented with an average-brightness mapping scheme.

6. The low-backlight image visibility enhancement method of claim 1, wherein the contrast enhancement process is implemented with a Weber's law based contrast enhancement algorithm.

7. The low-backlight image visibility enhancement method of claim 1, which is implemented with a parallel-processing operating scheme in which the brightness compensation module utilizes the average brightness of each preceding frame as the average brightness of each current frame for allowing each access operation to the input image and the brightness compensation process to be performed concurrently.

8. A low-backlight image visibility enhancement system for use with a backlit-type display unit for visibility enhancement of an input image that is to be displayed on the backlit-type display unit under a low-backlight condition;

the low-backlight image visibility enhancement system comprising:

a backlight reduction ratio setting module, which is capable of setting a backlight reduction ratio as a control parameter which is the ratio of the actual backlight intensity produced by the backlit-type display unit during operation against a rated maximum backlight intensity;

an image brightness extraction module, which is capable of extracting the brightness information of the input image to thereby produce a luminance-based image;

an image decomposition module, which is capable of decomposing the luminance-based image into a base-layer image and a detail-layer image, wherein the base-layer image is a low-pass filtered version of the original luminance-based image within a low-pass band, while the detail-layer image is a high-pass filtered version of the original luminance-based image within a high-pass band beyond the low-pass band;

a brightness compensation module, which is capable of performing a brightness compensation process on the base-layer image in accordance with an average-brightness mapping scheme based on the backlight reduction ratio and the average brightness value of the input image to thereby produce a brightness-compensated base-layer image;

a contrast enhancement module, which is capable of performing a contrast enhancement process on the detail-layer image to thereby produce a contrast-enhanced detail-layer image;

an image superimposition module, which is capable of superimposing the brightness-compensated base-layer image with the contrast-enhanced detail-layer image to thereby produce a single combined image; and a color conversion module, which is capable of performing a color conversion process on the combined image produced by the image superimposition module to thereby produce an output image for displaying on the backlit-type display unit.

9. The low-backlight image visibility enhancement system of claim 8, wherein the backlit-type display unit is a TFT-LCD (Thin-Film Transistor Liquid Crystal Display) active matrix display unit.

10. The low-backlight image visibility enhancement system of claim 8, wherein the backlight reduction ratio setting module is implemented with a factory-setting scheme for setting the backlight reduction ratio.

11. The low-backlight image visibility enhancement system of claim 8, wherein the backlight reduction ratio setting module is based on an auto-detection setting scheme for setting the backlight reduction ratio by first measuring the actual level of backlight intensity produced by the backlit-type display unit during operation, and then comparing the measured value against the rated maximum backlight intensity to obtain the value of the backlight reduction ratio.

12. The low-backlight image visibility enhancement system of claim 8, wherein the image brightness extraction module is based on a NTSC (National Television System Committee) standardized algorithm for performing the image brightness extraction process.

13. The low-backlight image visibility enhancement system of claim 8, wherein the image decomposition module is implemented with a bilateral filter.

14. The low-backlight image visibility enhancement system of claim 8, wherein the image decomposition module includes:

a low-pass digital image filter, which is capable of performing a low-pass filtering process on the luminance-based image to thereby produce a low-band digital image for use as the base-layer image; and a digital subtracter, which is capable of performing a subtraction process on the luminance-based image and the low-band digital image to thereby produce a high-band digital image for use as the detail-layer image.

15. The low-backlight image visibility enhancement system of claim 8, wherein the brightness compensation module is based on an average-brightness mapping scheme for performing the brightness compensation process.

16. The low-backlight image visibility enhancement system of claim 8, wherein the contrast enhancement module is based on a Weber's law based contrast enhancement algorithm for performing the contrast enhancement process.

17. The low-backlight image visibility enhancement system of claim 8, which is implemented with a parallel-processing operating scheme in which the brightness compensation module utilizes the average brightness of each preceding frame as the average brightness of each current frame for allowing each access operation to the input image and the brightness compensation process to be performed concurrently.

* * * * *